US007581501B1

(12) United States Patent
Boone et al.

(10) Patent No.: US 7,581,501 B1
(45) Date of Patent: Sep. 1, 2009

(54) DIPOLE ANTENNA PROJECTILE WITH SENSOR

(75) Inventors: Donald M. Boone, Bedford, PA (US); Carl Gotzmer, Accokeek, MD (US); Kenneth B. Johnson, Waldorf, MD (US); Leonard D. Lipton, Rockville, MD (US); Michael R. Scherr, Stafford, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 344 days.

(21) Appl. No.: 11/447,519

(22) Filed: May 31, 2006

(51) Int. Cl.
*F42B 12/00* (2006.01)
*F42B 10/04* (2006.01)
*F42B 30/00* (2006.01)

(52) U.S. Cl. ..... 102/517; 102/501; 102/439; 102/214

(58) Field of Classification Search ..... 102/501, 102/473, 214, 212, 293, 402, 517, 439; 244/3.14, 244/3.15, 3.19
See application file for complete search history.

(56) References Cited

U.S. PATENT DOCUMENTS 3,667,044 A * 5/1972 Vaughan et al. ..... 455/11.1
3,721,410 A * 3/1973 Anspacher ..... 348/144
3,852,756 A * 12/1974 Reese ..... 343/708
3,877,377 A * 4/1975 Rabinow ..... 102/214
4,207,841 A 6/1980 Bloomer
4,371,875 A 2/1983 Keydel
4,448,106 A * 5/1984 Knapp ..... 89/1.11
4,831,438 A * 5/1989 Bellman et al. ..... 348/148
5,238,204 A * 8/1993 Metz ..... 244/3.15
5,355,767 A * 10/1994 Morita ..... 89/41.07
5,381,445 A * 1/1995 Hershey et al. ..... 375/295
6,079,334 A * 6/2000 Roheim ..... 102/394
6,450,442 B1 9/2002 Schneider et al.
6,615,734 B2 9/2003 Koch et al.
6,636,182 B2 10/2003 Mehltretter
7,079,070 B2 * 7/2006 Kongelbeck et al. ..... 342/62
2004/0008035 A1 1/2004 Hickey

FOREIGN PATENT DOCUMENTS

GB 2304241 A * 3/1997

* cited by examiner

*Primary Examiner*—James S Bergin
(74) *Attorney, Agent, or Firm*—Fredric J. Zimmerman

(57) ABSTRACT

A fin-stabilized projectile suitable for launching from a shotgun or similar weapon. The projectile may penetrate easily breakable materials but will not penetrate tougher materials. The projectile may be shot through an easily breakable surface to gain entry to a target location, but further penetration is inhibited. The projectile is equipped with an on board sensor. The halves of the projectile casing form a dipole antenna for transmitting information gathered by the on board sensor.

18 Claims, 1 Drawing Sheet

DIPOLE ANTENNA PROJECTILE WITH SENSOR

STATEMENT OF GOVERNMENT INTEREST

The inventions described herein may be manufactured and used by or for the Government of the United States of America for government purposes without the payment of any royalties thereof.

BACKGROUND OF THE INVENTION

The invention relates in general to projectiles and in particular to projectiles equipped with sensors for transmitting data from the projectile to a base station.

There are situations when it is desired to sense, remotely, an area. The phenomenon that is being sensed may be acoustic waves (i.e., to overhear human speech), heat, chemical presence, environmental conditions, or other measurable items. The placement of the sensor may be difficult in situations such as urban military combat, civilian law enforcement (i.e., covert surveillance or hostage rescue operations) and civilian firefighter rescue operations. These and other situations require placement of the sensor from a distance. In the past, such sensors were manually placed by a human who was subjected to great risk of harm.

The present invention overcomes the risks associated with manual placement of sensors by providing a remote sensing device that may be launched from a tube, such as, for example, a shotgun.

SUMMARY OF THE INVENTION

An aspect of the invention is a projectile including a hollow conductive casing including a forward section and a rear section, and an insulating ring disposed between the forward section and the rear section to isolate, electrically, the forward section from the rear section whereby the forward and rear sections comprise a dipole antenna. In an embodiment, the forward and rear sections are made from a metal material. The projectile may further include a tail fin disposed aft of the rear section. For sensing purposes, at least one sensor is disposed in the conductive casing.

Another aspect of the invention is a projectile including a hollow casing, a tail fin disposed on an aft end of the hollow casing, and an axial rod disposed on a longitudinal axis of the projectile where one end of the axial rod protrudes outward from a forward section of the hollow casing and another end of the axial rod connects to the tail fin. The projectile may further include a relatively soft, ductile material that fills a volume in a forward end of the forward section and a relatively hard, dense material that fills a volume adjacent to and aft of the relatively soft material. At least one sensor may be disposed in the casing.

BRIEF DESCRIPTION OF THE DRAWINGS

The FIG. 1 which is not necessarily to scale, is a schematic view, partially in section, of an embodiment of a projectile in accordance with the invention.

DETAILED DESCRIPTION OF EXEMPLARY EMBODIMENTS OF THE INVENTION

Figure 1:
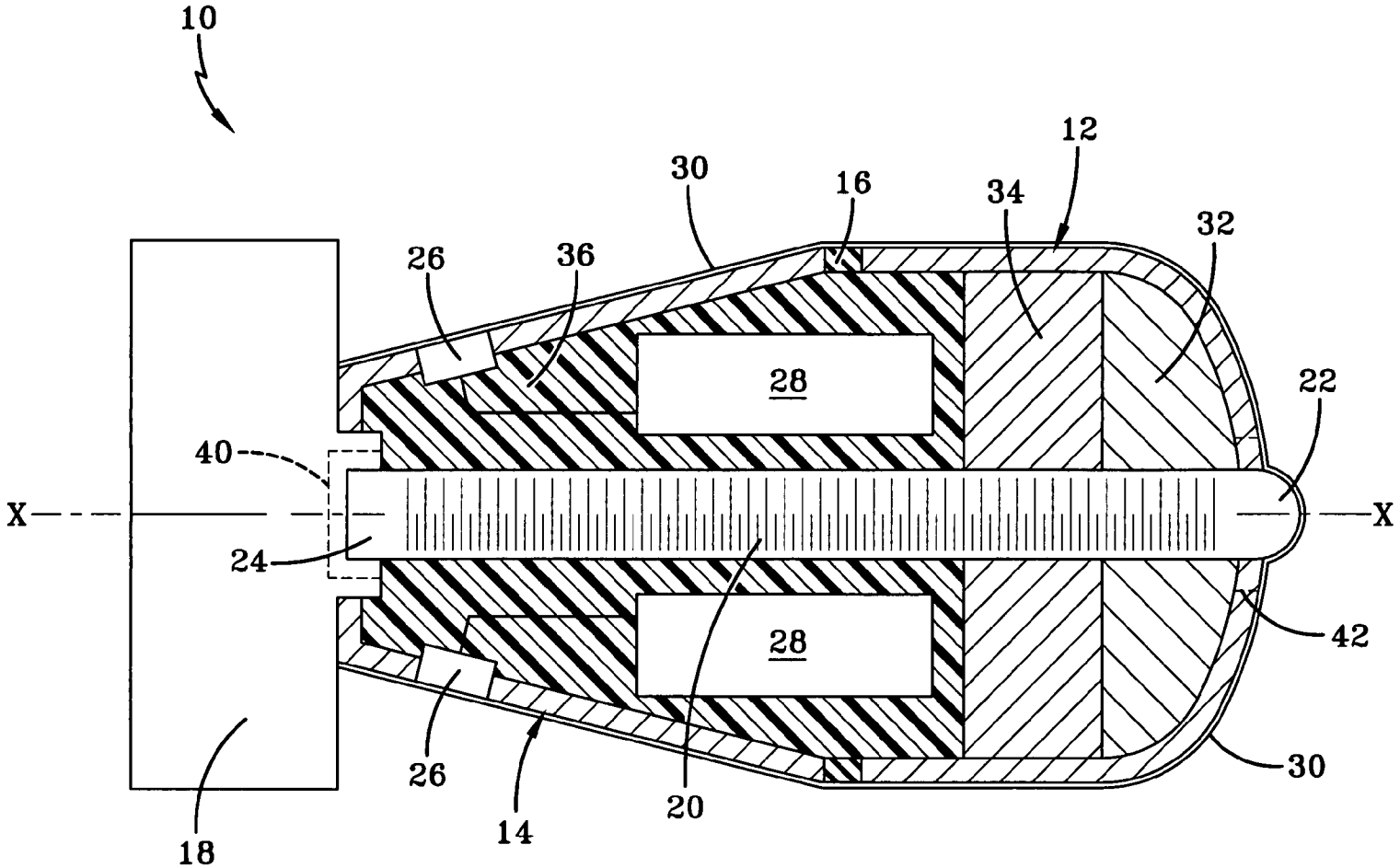

The present invention is a fin-stabilized projectile suitable for launching from, for example, a 12-gauge shotgun, 37 mm or 40 mm gun or a similar weapon. The projectile is designed to penetrate some easily breakable materials, such as, a double-pane window, but to not penetrate tougher materials, such as, walls. In this example, the projectile may be shot through a window to gain entry to a target location, but further penetration is inhibited. The projectile is designed to be launched from a distance of about 100 feet and have a radio frequency transmitting range of about 300 feet. The ability of remote emplacement reduces the risk to operating personnel.

Referring now to the FIG. 1, an embodiment of a projectile 10 in accordance with the invention includes a hollow conductive casing including a forward section 12 and a rear section 14. An insulating ring 16 is disposed at approximately the midpoint between the forward section 12 and the rear section 14 to insulate, electrically, the forward section 12 from the rear section 14 so that the forward and rear sections 12, 14 comprise, that is, form a dipole antenna. Forward and rear sections 12, 14 must be electrically conductive and therefore may be made of a metal material. An exemplary overall length for the projectile 10 is about one and a half inches.

The projectile 10 further includes a tail fin 18 disposed aft of the rear section 14. An axial rod 20 (such as a threaded screw or bolt) is disposed on the longitudinal axis X-X of the projectile 10. One end 22 of the axial rod 20 protrudes slightly outwards from the forward section 12. This end 22 may have, for example, a shape of a rounded end. The other end 24 of the axial rod 20 connects to the tail fin 18, using, for example, threads.

It is important that the forward and rear sections 12, 14 be electrically insulated from each other. This electrical isolation may be accomplished in different ways, although the insulating ring 16 is present in each embodiment. In an embodiment, the tail fin 18 is made of an electrically insulating material so that the axial rod 20 may be made of a conductive material, such as a metal, and may contact forward section 12 where rod 20 protrudes outward from forward section 12. An optional insulating bushing or washer 40 (shown in dashed lines in the FIG. 1) may surround rod 20 so that tail fin 18 may be made of a conductive material. In another embodiment, the axial rod 20 may be made of an insulating material. In yet another embodiment, an optional insulating bushing or washer 42 (shown in dashed lines in the FIGURE) may be used to prevent rod 20 from contacting forward section 12.

At least one sensor 26 is disposed in the conductive casing, for example, in the rear section 14. The sensor may be, for example, an acoustic sensor (microphone), a heat sensor, a chemical sensor, or other sensor. Known radio frequency electronics 28 are connected to the sensors 26 and the dipole antenna 12, 14 (connection not shown) for transmitting information received from the sensors 26. The electronics 28 include a power supply (not shown), such as a lithium battery that is activated by an inertial switch. The projectile 10 is internally potted with, for example, epoxy 36 to provide inertial damping for the internal components. The projectile 10 may be color-coded to associate it with a fixed frequency for the radio transmitter. In an embodiment, the projectile 10 is coated with an insulating material 30, such as, TEFLON, to maintain insulation between the front and rear sections 12, 14 in wet, electrically-conductive environments.

The radio frequency electronics 28 include a transmitter circuit that matches the dipole. The transmitter circuit has two feed wires (not shown) that connect to dipole antenna sections 12, 14, respectively, 180 degrees out of phase. In an exemplary embodiment, a location of the feed wires is on either side of the insulating ring 16 and close to the insulating ring 16. Further, the matching transmitter circuit may be placed at the ring 16. However, due to the small size of the device, placement of the RF components may not be critical.

A relatively soft, ductile material 32 fills the volume in the forward end of the forward section 12 and a relatively hard, dense material 34 fills the volume adjacent to and aft of the relatively soft, ductile material 32. An example of material 34 is a dense, hard metal alloy such as, a copper alloy or steel, generally with a yield stress of several million psi. A relatively high density is needed to ensure projectile flight stability.

An exemplary material 32 is one with a relatively low yield stress and a relatively high ductility so that it deforms upon first impact and the deformation is permanent. High ductility is indicated by relatively high values of elongation at fracture and reduction in area observed during standard tensile tests. It is intended that material 32 may permanently deform and increase its diameter upon penetration of a barrier, such as, a window, thereby reducing the likelihood that the projectile 10 may penetrate a second barrier, such as, an internal wall.

In use, the projectile 10 is generally launched from a gun, such as, a 12 gauge shotgun, into an area that one wishes to monitor with the sensors 26. The projectile 10 will penetrate, for example, a glass window, but will not penetrate a wall or floor because of the structural nose features. An inertial sensor may activate the power supply for the electronics 28. The sensors 26 begin sensing and the electronics 28 transmit the sensors' signals via the dipole antenna sections 12, 14 to a remote listening location.

While the invention has been described with reference to certain preferred embodiments, numerous changes, alterations and modifications to the described embodiments are possible without departing from the spirit and scope of the invention as defined in the appended claims, and equivalents thereof.

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

What is claimed is:

1. A projectile, comprising:

a hollow conductive casing comprising a forward section and a rear section;

an insulating ring being disposed between the forward section and the rear section to insulate, electrically, the forward section from the rear section, wherein the forward section and the rear section comprise a dipole antenna, and radio frequency electronics connected to at least one sensor and the dipole antenna for transmitting information provided by said at least one sensor to a receiving location, wherein the forward section includes a soft, ductile material adjacent a relatively hard, dense material.

2. The projectile of claim 1, wherein the forward section and the rear section are comprised of a metal material.

3. The projectile of claim 1, further comprising a tail fin being disposed aft of the rear section.

4. The projectile of claim 3, further comprising an axial rod being disposed on a longitudinal axis of the projectile, one end of the axial rod protrudes outward from the forward section and another end of the axial rod connects to the tail fin.

5. The projectile of claim 3, further comprising an axial rod being disposed on a longitudinal axis of the projectile, wherein the axial rod is comprised of metal.

6. The projectile of claim 1, further comprising said at least one sensor being disposed in the hollow conductive casing.

7. The projectile of claim 6, wherein said at least one sensor is an acoustic sensor.

8. The projectile of claim 1, further comprising an insulating material covering an external surface of the projectile.

9. The projectile of claim 1, wherein said relatively soft, ductile material fills a volume in a forward end of the forward section, and wherein said relatively hard, dense material fills a volume adjacent to and aft: of the relatively soft material.

10. A projectile, comprising:

a hollow casing comprising a forward section;

a tail fin being disposed on an aft end of the hollow casing;

an axial rod being disposed on a longitudinal axis of the projectile, one end of the axial rod protruding outwards from a forward section of the hollow casing and another end of the axial rod connecting to the tail fin; and radio frequency electronics being connected to at least one sensor and a dipole antenna for transmitting information being provided by said at least one sensor to a receiving location, wherein the forward section includes a soft, ductile material adjacent a relatively hard, dense material.

11. The projectile of claim 10, wherein said relatively soft, ductile material fills a volume in a forward end of the forward section, and wherein said relatively hard, dense material fills a volume adjacent to and aft of the relatively soft material.

12. The projectile of claim 10, wherein the axial rod is comprised of a metal.

13. The projectile of claim 10, further comprising said at least one sensor being disposed in the hollow casing.

14. The projectile of claim 13, wherein said at least one sensor is an acoustic sensor.

15. The projectile of claim 10, wherein the hollow casing comprises a conductive casing, the conductive casing is comprised of the forward section and a rear section, and wherein an insulating ring is disposed between the forward section and the rear section to insulate, electrically, the forward section from the rear section whereby the forward section and the rear section comprise a dipole antenna, radio frequency electronics are connected to the dipole antenna.

16. The projectile of claim 15, wherein the forward section and the rear section are comprised of a metal material.

17. The projectile of claim 10, wherein the tail fin is comprised of an electrically insulating material.

18. The projectile of claim 10, further comprising an insulating material, which covers an external surface of the projectile.

* * * * *